US009203179B2

(12) United States Patent
Ohyama

(10) Patent No.: US 9,203,179 B2
(45) Date of Patent: Dec. 1, 2015

(54) WATERPROOF CONNECTOR HAVING A HOUSING INTEGRALLY FORMED WITH A SEALING PART INTEGRALLY FORMED WITH TERMINALS JOINED TO CONDUCTORS OF A FLAT CABLE

(71) Applicant: Yazaki Corporation, Tokyo (JP)

(72) Inventor: Kouichi Ohyama, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/343,188

(22) PCT Filed: Sep. 24, 2012

(86) PCT No.: PCT/JP2012/075275

§ 371 (c)(1),
(2) Date: Mar. 6, 2014

(87) PCT Pub. No.: WO2013/047854

PCT Pub. Date: Apr. 4, 2013

(65) Prior Publication Data

US 2014/0220804 A1 Aug. 7, 2014

(30) Foreign Application Priority Data

Sep. 26, 2011 (JP) ..... 2011-208478

(51) Int. Cl.
*H01R 13/52* (2006.01)
*H01R 43/20* (2006.01)
(Continued)

(52) U.S. Cl.
CPC ..... *H01R 13/5221* (2013.01); *H01R 12/592* (2013.01); *H01R 12/772* (2013.01); *H01R13/5216* (2013.01); *H01R 13/5845* (2013.01); *H01R 43/16* (2013.01); *H01R 43/20* (2013.01); *H01R 43/005* (2013.01); *Y10T 29/49204* (2015.01)

(58) Field of Classification Search
CPC ..... H01R 13/62; H01R 43/16; H01R 43/18; H01R 43/20
USPC ..... 439/271–275; 29/874
See application file for complete search history.

(56) References Cited

U.S. PATENT DOCUMENTS

2004/0047136 A1 3/2004 Takenaka et al.
2005/0255741 A1 11/2005 Ashida et al.
(Continued)

FOREIGN PATENT DOCUMENTS

CN 1473379 A 2/2004
CN 1675805 A 9/2005
(Continued)

OTHER PUBLICATIONS

International Search Report dated Dec. 5, 2012, issued by the International Searching Authority in counterpart International Application No. PCT/JP2012/075275.
(Continued)

*Primary Examiner* — Chandrika Prasad
(74) *Attorney, Agent, or Firm* — Sughrue Mion, PLLC

(57) ABSTRACT

A waterproof connector includes a flexible flat cable formed in a flat plate shape and having a plurality of conductors and an insulating film covering the plurality of the conductors, terminals contacted to the conductors of the flexible flat cable respectively, a cable holding part integrally formed to the flexible flat cable so as to include joint parts between the conductors and the terminals, and a connector housing. A hole is formed between the conductors of the flexible flat cable, and a slit is formed in an end portion of the flexible flat cable in a width direction thereof. The cable holding part includes a sealing part integrally formed to the conductors and the terminals so as to include the joint parts and a holding part integrally formed to the flexible flat cable and covering the sealing part.

4 Claims, 8 Drawing Sheets

(51) Int. Cl.

| | |
|---|---|
| ***H01R 12/59*** | (2011.01) |
| ***H01R 12/77*** | (2011.01) |
| ***H01R 13/58*** | (2006.01) |
| ***H01R 43/16*** | (2006.01) |
| *H01R 43/00* | (2006.01) |

(56) References Cited

U.S. PATENT DOCUMENTS

| | | | | |
|---|---|---|---|---|
| 2012/0040571 | A1 | 2/2012 | Yoshioka et al. | |
| 2013/0109212 | A1* | 5/2013 | Ohyama et al. | 439/272 |

FOREIGN PATENT DOCUMENTS

| | | | |
|---|---|---|---|
| EP | 1317026 | A1 | 6/2003 |
| JP | H 7106014 | A | 4/1995 |
| JP | 2008171597 | A | 7/2008 |
| JP | 2010-123513 | A | 6/2010 |
| WO | 2011001840 | A1 | 1/2011 |

OTHER PUBLICATIONS

Written Opinion dated Dec. 5, 2012, issued by the International Searching Authority in counterpart International Application No. PCT/JP2012/075275.

Office Action dated May 12, 2015, issued by the Japanese Intellectual Property Office in counterpart Japanese Application No. 2011-208478.

Office Action dated Jul. 13, 2015, issued by the State Intellectual Property Office of P.R. China in counterpart Chinese Application No. 201280046919.3.

Office Action dated Jul. 6, 2015, issued by the Korean Intellectual Property Office in counterpart Korean Application No. 10-2014-7007037.

* cited by examiner

WATERPROOF CONNECTOR HAVING A HOUSING INTEGRALLY FORMED WITH A SEALING PART INTEGRALLY FORMED WITH TERMINALS JOINED TO CONDUCTORS OF A FLAT CABLE

TECHNICAL FIELD

The present invention relates to a waterproof connector with a flat cable and a manufacturing method thereof.

BACKGROUND ART

In the case of arranging a cable in small space, a flat cable with a flat plate shape configured to have flexibility has conventionally been used as the cable capable of being arranged in the small space. This flat cable is constructed so that a terminal of the flat cable connected to a terminal of a connector of the other connection side is connected to the portion to which conductor wiring of the flat cable is exposed.

It is necessary to waterproof a joint part between the conductor wiring and the terminal for connecting the terminal to such conductor wiring in order to prevent water from entering from the outside. Because of this, a waterproof connector with a flat cable for sealing the joint part between the conductor wiring and the terminal with a synthetic resin has been proposed as shown in, for example, PTL 1 (Patent Literature 1).

The waterproof connector described in PTL 1 is constructed so that a molded part 6 made of a synthetic resin in which the outer periphery of a flat cable 1 including a hole 5 positioned between conductors 2, 2 is provided with a pull taper tapered toward the front end of the flat cable 1 is integrally molded over the whole periphery by the front end in a longitudinal direction of the flat cable 1 and the longitudinal middle in the molded part 6 has no longitudinal parting line over the whole periphery and an undercut part 7 is formed in the back end of the molded part 6 forming the start end side of the pull taper.

Then, the waterproof connector described in PTL 1 is constructed so that an integrally molded part integrally molded of rubber and a thermoplastic elastomer is formed on a flexible flat cable (FFC) and means obtained by wrapping a ring-shaped rubber plug around the integrally molded part is inserted into a connector housing and sealability is ensured.

Also, the waterproof connector described in PTL 1 includes a structure constructed so that an integrally molded part integrally molded of rubber and a thermoplastic elastomer is formed on a flexible flat cable (FFC) and a ring-shaped rubber plug is wrapped around the integrally molded part and a grip part of the integrally molded part is formed on the periphery of the back of the rubber plug to form a flange (retainer) fitted into a connector housing and the grip part is inserted into the connector housing and sealability is ensured.

CITATION LIST

Patent Literature

[PTL 1] JP-A-2010-123513

SUMMARY OF INVENTION

Technical Problem

In the waterproof connector described in PTL 1 constructed thus, a flexible flat cable (FFC) 100 is coated with an integrally molded part 110 integrally molded of rubber and a thermoplastic elastomer to form a close contact part 110*a* as shown in FIG. 8. Further, a ring-shaped rubber plug 120 is fitted around this integrally molded part 110. Then, the end of the flexible flat cable (FFC) 100 to which this integrally molded part 110 and the rubber plug 120 are attached is inserted into a connector housing 130 to construct a connection structure between a terminal and the flat cable described in PTL 1.

Then, in the waterproof connector described in PTL 1, in order to improve a holding force by which the flexible flat cable (FFC) 100 is held, a hole is bored in the flexible flat cable (FFC), and the integrally molded part (close contact part) 110 in which rubber and a thermoplastic elastomer are integrally molded with the flexible flat cable (FFC) 100 is formed.

That is, in the case of forming the integrally molded part (close contact part) 110 in which the rubber and the thermoplastic elastomer are integrally molded with the flexible flat cable (FFC) 100, molten rubber and thermoplastic elastomer enters the hole bored in the flexible flat cable (FFC) 100 and bonds, and the holding force by which the flexible flat cable (FFC) 100 is improved.

However, in the waterproof connector described in PTL 1, in a connector assembly process, a pull force (external force) A generally occurs in the flexible flat cable 100 as shown in FIG. 8.

When this external force A occurs, the force is applied to the close contact part 110*a* in which the integrally molded part 110 makes contact with the flexible flat cable 100 by this external force A. In the waterproof connector described in PTL 1, the holding force is improved by boring the hole in the flexible flat cable (FFC), but when the pull force (external force) A is applied, the force is also applied to the close contact part 110*a* and there are problems of decreasing sealability and also decreasing the holding force due to decrease in the sealability.

Holding of the sealability requires close contact properties in the close contact part 110*a* between the flexible flat cable 100 and the integrally molded part 110.

Also, in the waterproof connector in which a flange (retainer) is formed on the integrally molded part 110 with which the flexible flat cable 100 is covered as described in PTL 1, the flange (retainer) has an effect in holding of the integrally molded part 110 and the connector housing 130 or holding of the integrally molded part 110 and the rubber plug 120, but has a problem of having no effect in holding of the close contact part of the flexible flat cable 100 and the integrally molded part 110.

The invention has been implemented in view of the circumstances described above, and an object of the invention is to provide a waterproof connector with a flat cable capable of ensuring sealability and a holding force of a flexible flat cable and an integrally molded part even when a pull force (external force) is applied to the flexible flat cable, and a manufacturing method of the waterproof connector with the flat cable.

Solution to Problem

In order to achieve the above object, according to the present invention, there is provided a waterproof connector comprising:

a flexible flat cable formed in a flat plate shape and having a plurality of conductors which are arranged in parallel with interval and an insulating film covering the plurality of the conductors;

terminals contacted to the conductors of the flexible flat cable respectively;

a cable holding part integrally formed to the flexible flat cable so as to include joint parts between the conductors and the terminals; and a connector housing having one end including the cable holding part and the other end at which the mating connector is fitted, wherein a hole is formed between the conductors of the flexible flat cable, and a slit is formed in an end portion of the flexible flat cable in a width direction thereof; and wherein the cable holding part includes:

a sealing part integrally formed of a thermoplastic elastomer or a resin with high close contact properties to the conductors and the terminals so as to include the joint parts between the conductors and the terminals; and a holding part integrally formed of a high rigidity resin to the flexible flat cable and covering the sealing part.

For example, the holding part includes a protrusion portion which is entered into the hole of the flexible flat cable, and a retaining part which retains to a part of the slit.

According to the present invention, there is also provided a manufacturing method of a waterproof connector, comprising:

providing a flexible flat cable formed in a flat plate shape and having a plurality of conductors which are arranged in parallel with interval and an insulating film covering the plurality of the conductors;

providing terminals contacted to the conductors of the flexible flat cable respectively;

providing a connector housing;

forming a hole in the insulating film between the conductors of the flexible flat cable;

forming a slit in an end portion of the insulating film of the flexible flat cable in a width direction;

contacting the terminals to the conductors of the flexible flat cable;

forming a sealing part of a thermoplastic elastomer or a resin with high close contact properties integrally to the conductors and the terminals so as to include the joint parts between the conductors and the terminals;

forming a holding part of a high rigidity resin integrally to the flexible flat cable so as to cover the sealing part; and fitting the holding part into one end of the connector housing after the holding par is formed.

For example, in the process of forming the sealing part, a high rigidity resin enters into the hole of the flexible flat cable, and a part of the slit is covered with the high rigidity resin.

Advantageous Effects of Invention

According to the above configurations and methods, when an external force occurs, the force is previously applied to the holding part constructed of a high rigidity resin material and the flexible flat cable is held and action of the external force on the sealing part constructed of a thermoplastic elastomer or a resin material with high close contact properties is reduced and sealability can be ensured.

BRIEF DESCRIPTION OF DRAWINGS

FIGS. 7A to 7C are perspective views showing a manufacturing method of the waterproof connector with the flat cable according to the embodiment of the invention.

DESCRIPTION OF EMBODIMENTS

Figure 1:
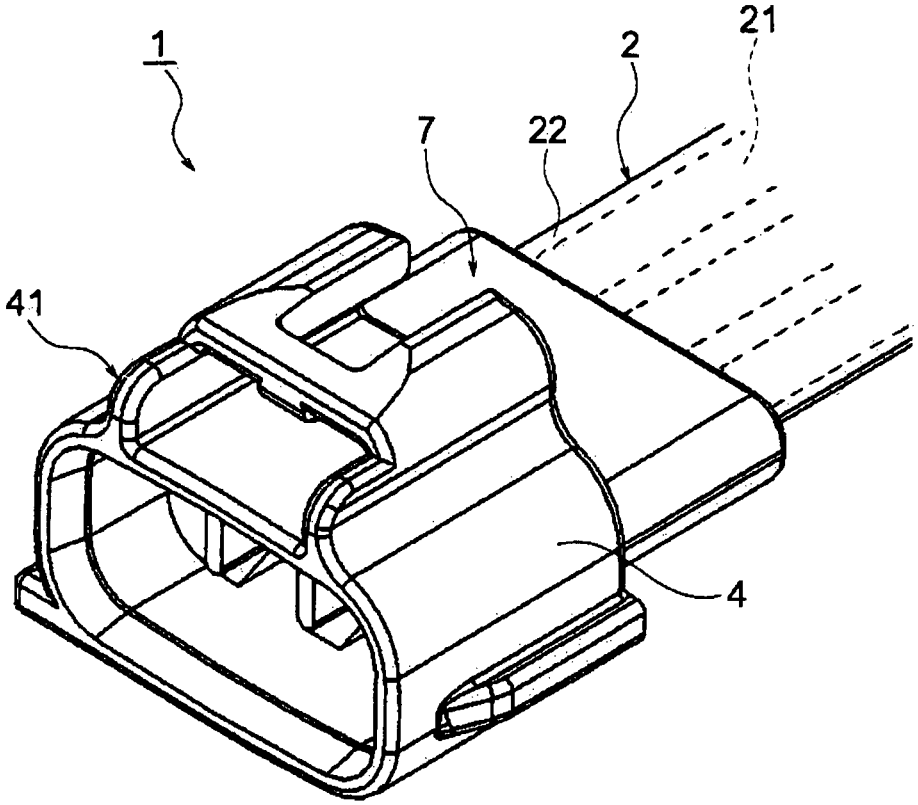
FIG. 1 is a perspective view showing the whole configuration of a waterproof connector with a flat cable according to an embodiment of the invention.
Figure 2:
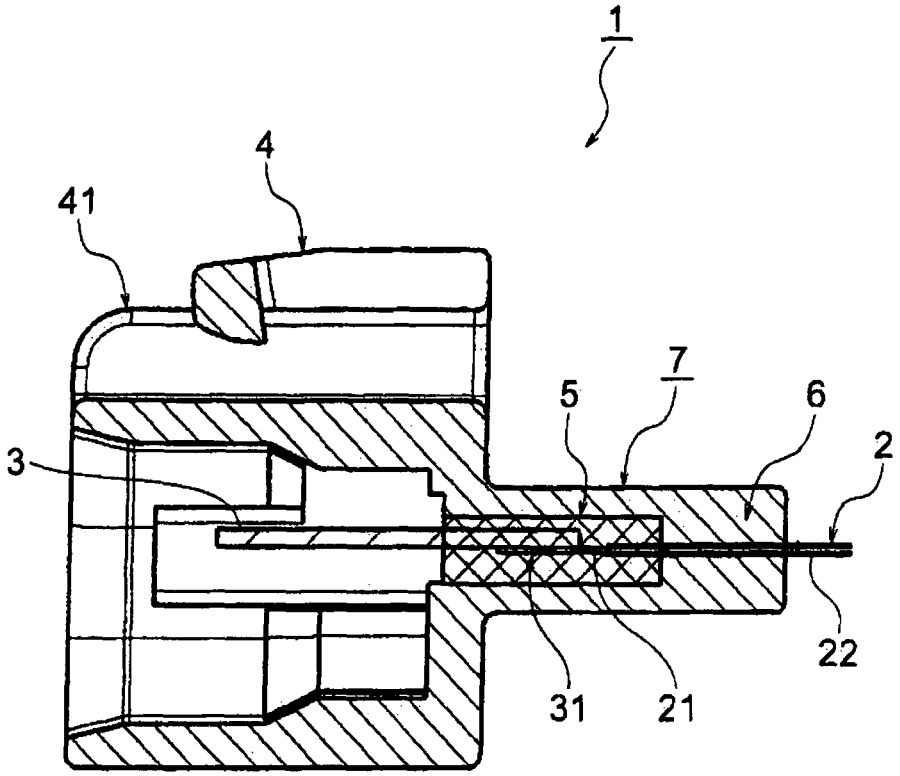
FIG. 2 is a sectional view of the waterproof connector with the flat cable shown in FIG. 1.

An embodiment of a waterproof connector with a flat cable according to the invention and a manufacturing method thereof will hereinafter be described with reference to the drawings.

Example 1

FIGS. 1 to 6 show an example of the waterproof connector with the flat cable according to the embodiment of the invention.

In the drawings, a waterproof connector with a flat cable (hereinafter refereed to as a waterproof connector 1) according to the embodiment of the invention has a flexible flat cable 2, plural terminals 3, a connector housing 4, and a cable holding part 7 including a sealing part 5 and a holding part 6.

Figure 3:
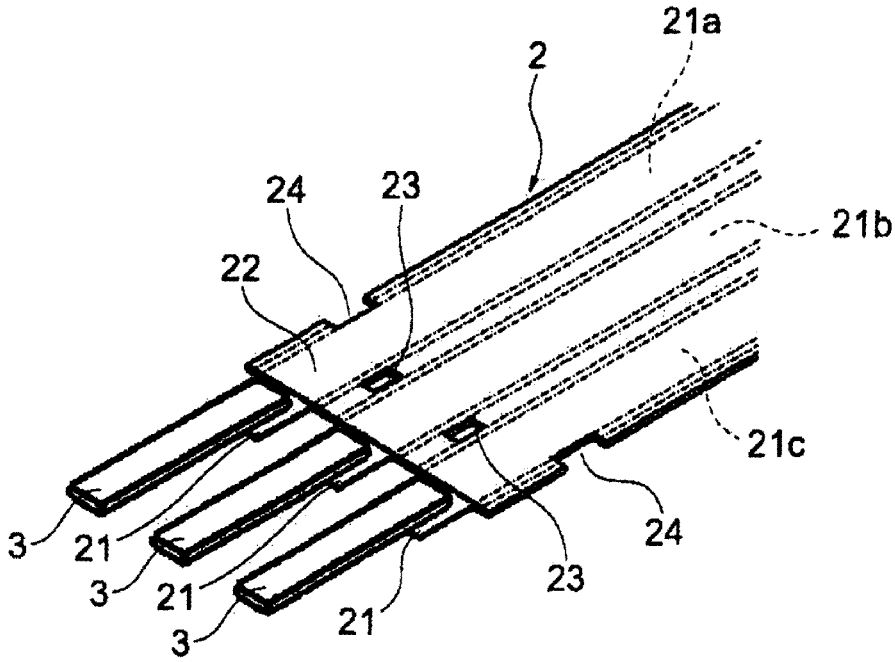
FIG. 3 is a view showing a state that terminals are contacted to conductors of a flexible flat cable in which holes are formed in an insulating film between the conductors and slits are formed in ends in a width direction.

The flexible flat cable 2 includes plural conductors 21 and an insulating film 22 as shown in FIG. 3.

The plural conductors 21 are made of, for example, copper or copper alloy, and have flexibility, and are configured to have three conductors 21 in the present example. These three conductors 21 are parallel arranged in correspondence with parallel distances of the terminals 3, and are coated or covered with the insulating film 22 so as to pinch the conductors 21 from the upward and downward sides, and are formed in a flat plate shape.

In addition, in the present example, the three conductors 21 are shown, but the number of conductors is not limited to three. That is, the number of conductors 21 may be one or more.

In the insulating film 22, the conductors 21 are coated with an insulating material such as polypropylene.

Such a flat cable 2 is formed in a flat plate shape while parallel spacing the conductors 21 and being coated with the insulating film 22 so as to pinch the conductors 21 from the upward and downward sides. The flat cable 2 has flexibility by being coated in the flat plate shape in this manner.

Also, in the distal end of this flat cable 2, the insulating film 22 is removed and the conductors 21 are exposed and the terminal 3 is contacted to each of the exposed conductors 21.

The insulating film 22 is provided with a vertical through hole 23 arranged between the conductors 21. This hole 23 is bored in two places between the conductor 21*a* and the conductor 21*b* and between the conductor 21*b* and the conductor 21*c* in the present example.

Also, at both ends of the flexible flat cable 2 in a width direction, recess-shaped or U-shaped slits 24 are formed in the insulating film 22. The flexible flat cable 2 is formed by parallel arranging the plural conductors 21 and being coated with the insulating film 22 from the upward side. That is, recesses are formed at both ends of the flexible flat cable 2 in the width direction toward the center in the width direction by the slits 24.

The terminal 3 is formed of metal having conductivity, and is formed in a long plate shape having a predetermined length, corresponding to each of the conductors 21. This terminal 3 is contacted to each of the conductors 21 of the flexible flat cable 2 by methods of ultrasonic welding, crimping, etc., and a joint part 31 is formed by each of the terminals 3 and each of the conductors 21.

In the present example, each of the terminals 3 is a male terminal, and one end portion of each of the terminals 3 opposite to the other end portion where the joint part 31 is contacted to each of the conductor 21 is connected to a mating connection terminal.

In addition, in the present example, the flat cable waterproof connector structure 1 has three terminals 3, but the number of terminals 3 is not limited to three, and the number of terminals 3 may be one or more.

The joint parts 31 in which the terminals 3 are contacted to the conductors 21 and the terminals 3 projecting from the joint part 31 are contained in the connector housing 4.

The connector housing 4 is formed of a synthetic resin having rigidity, and is constructed so as to be able to be fitted into a mating connector (not shown) so that the terminals 3 can be connected to the other connection terminals (not shown).

This connector housing 4 has a fitting part 41 fitted into the mating connector (not shown), and the cable holding part 7 for holding the flexible flat cable 2.

The fitting part 41 is formed in a tubular shape whose cross section has an oval external shape, and is constructed so that the other connector (not shown) is fitted into the inside of the fitting part 41. That is, the terminals 3 are connected to terminals of the other connector (not shown) by fitting the other connector (not shown) into the fitting part 41.

The cable holding part 7 includes the sealing part 5 and the holding part 6, and is the portion for holding the flexible flat cable 2 including the joint part 31 between the terminal 3 and the conductor 21 of the flexible flat cable 2.

The sealing part 5 is made of a resin. In the sealing part 5, the terminal 3 with a predetermined distance toward the side of the fitting part 41 of the connector housing 4 from the joint part 31 and the conductor 21 with a predetermined distance toward a longitudinal direction of the flexible flat cable 2 from the joint part 31 are coated by integral molding so as to include the joint part 31 in which the terminal 3 is contacted to the conductor 21 of the flexible flat cable 2.

That is, the sealing part 5 is formed by being coated with the resin so as to cover the terminal 3 and the conductor 21 including the joint part 31 in which the terminal 3 is contacted to the conductor 21 of the flexible flat cable 2.

The sealing part 5 is formed by integrally molding of a thermoplastic elastomer or a resin with high close contact properties. This resin with high close contact properties is a resin having close contact properties higher than those of a normal resin. Also, the thermoplastic elastomer is constructed of a thermoplastic elastomer resin such as styrene-butadiene series, polyolefin series, urethane series, polyester series, polyamide series, 1,2-polybutadiene, polyvinyl chloride series, or ionomer.

The conductor 21 with a predetermined distance toward a longitudinal direction from a formation region of the insulating film 22 of the flexible flat cable 2 is coated with this sealing part 5 by integral molding. The properties of adhesion and close contact between this sealing part 5 and the insulating film 22 become high since the sealing part 5 is formed of the thermoplastic elastomer or the resin with high close contact properties and the insulating film 22 is formed of an insulating material such as polypropylene.

Therefore, when the sealing part 5 of the cable holding part 7 is formed of the thermoplastic elastomer or the resin with high close contact properties by integral molding, the properties of close contact between the sealing part 5 and the terminal 3 and close contact between the sealing part 5 and the conductor 21 can be improved.

Figure 4:
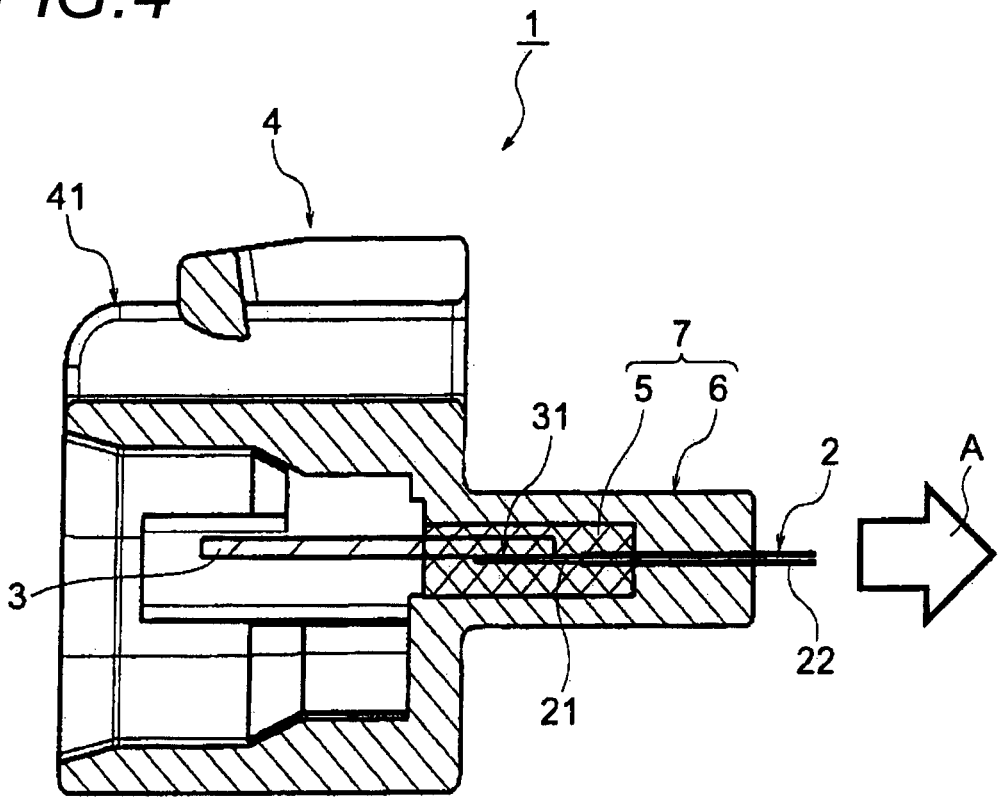
FIG. 4 is a view showing a state that an external force is applied to the waterproof connector with the flat cable shown in FIG. 1.
Figure 5:
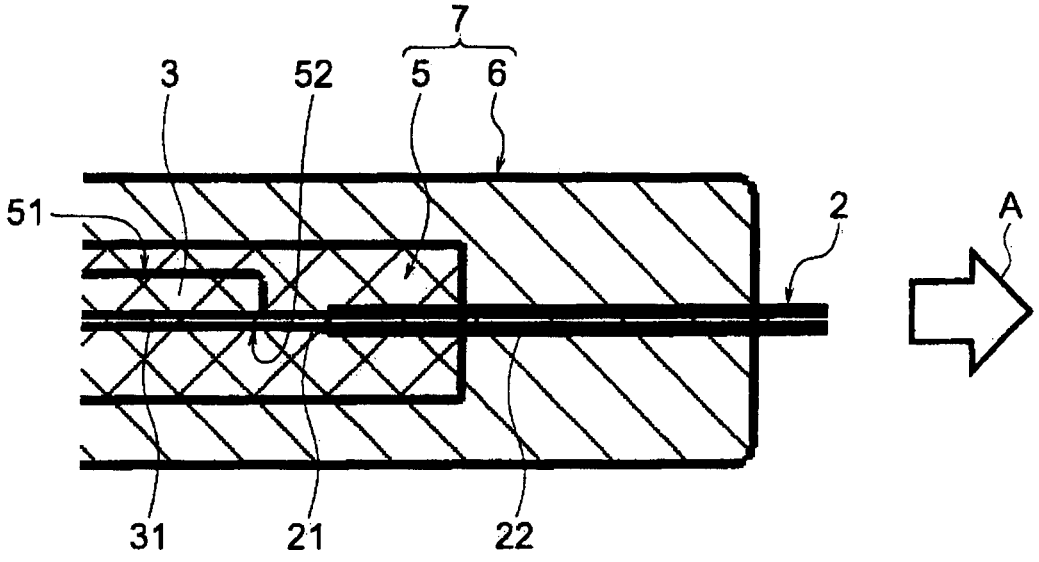
FIG. 5 is an enlarged perspective view of an integrally molded sealing part shown in FIG. 1.

As a result, when an external force A by which the flexible flat cable 2 is pulled out of the connector housing 4 is applied to the flexible flat cable 2 as shown in FIG. 4, the force is applied to a close contact part 51 in which the terminal 3 makes contact with the sealing part 5 in the sealing part 5, and a close contact part 52 in which the conductor 21 makes contact with the sealing part 5.

However, even when the force is applied to the close contact part 51 and the close contact part 52, the properties of close contact between the flexible flat cable 2 and the sealing part 5 are high, so that the close contact properties are not decreased by the external force A and the sufficient close contact properties can be maintained.

Figure 6:
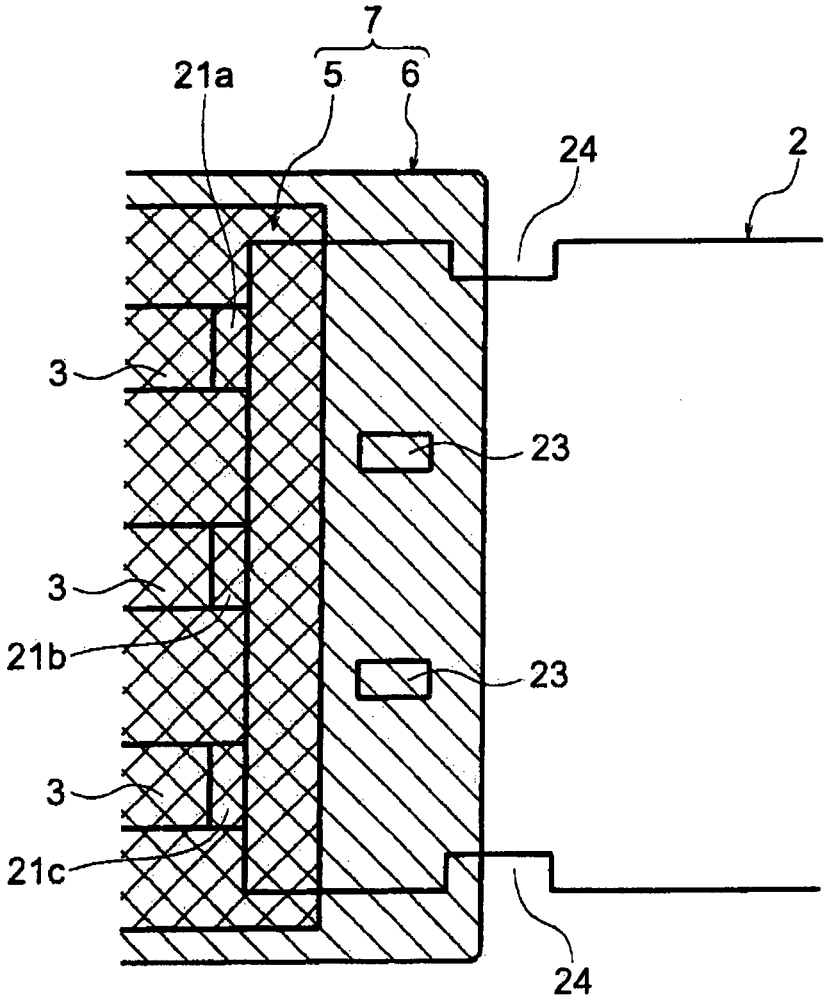
FIG. 6 is a view showing a relation between a holding part and the sealing part of the waterproof connector with the flat cable shown in FIG. 1.

The holding part 6 is a resin with which the outer periphery of the sealing part 5 is coated by integral molding so as to cover the sealing part 5 and cover the holes 23 and the slits 24 of the flexible flat cable 2 as shown in FIG. 6. Then, this holding part 6 constructs the cable holding part 7 constructing the connector housing 4.

The holding part 6 is integrally molded of a high rigidity resin. This high rigidity resin is generally a thermoplastic resin such as polybutylene terephthalate (PBT), polypropylene (PP), polyamide (PA) or a liquid crystal polymer used in material of the connector housing, and is constructed of a resin having rigidity sufficient to form the connector housing 4.

The insulating film 22 of the flexible flat cable 2 is provided with the holes 23 in two places.

When the outer periphery of the sealing part 5 is coated with the holding part 6 by integral molding so as to cover the sealing part 5 and cover the holes 23 and the slits 24 of the flexible flat cable 2, the coated resin in the case of forming the holding part 6 on the insulating film 22 enters the holes 23 from both sides of the holes 23 of the flexible flat cable 2.

Therefore, when the external force A by which the flexible flat cable 2 is pulled out of the connector housing 4 is applied to the flexible flat cable 2 as shown in FIG. 4, the resin which enters the holes 23 and forms the holding part 6 plays the role of a stopper with respect to the direction in which the flexible flat cable 2 is pulled out of the connector housing 4.

As a result, even when the external force A by which the flexible flat cable 2 is pulled out of the connector housing 4 is applied to the flexible flat cable 2, the flexible flat cable 2 is not detached from the holding part 6 and the flexible flat cable 2 can surely be held by the holding part 6.

In the two holes 23 with which the insulating film 22 of the flexible flat cable 2 is provided thus, a coated resin which enters the holes 23 and forms the holding part 6 when a molten resin for forming the holding part 6 enters from both sides of the holes 23 and the external force of the pull-out direction is applied to the flexible flat cable 2 in the case of coating the insulating film 22 with the resin for forming the holding part 6 plays the role of a stopper. That is, the holes 23 are means in which by the resin entering the holes 23, the flexible flat cable 2 is not detached from the holding part 6 by the external force and the flexible flat cable 2 can surely be held by the holding part 6.

Both ends in a width direction of the flexible flat cable 2 are provided with the recess-shaped or U-shaped slits 24 in the insulating film 22 of the flexible flat cable 2.

When the outer periphery of the sealing part 5 is coated with the holding part 6 by integral molding so as to cover the sealing part 5 and cover the slits 24 of the flexible flat cable 2, the coated resin in the case of forming the holding part 6 on the insulating film 22 enters the slits 24 and the holding part 6 is formed as shown in FIG. 6.

Therefore, when the external force A by which the flexible flat cable 2 is pulled out of the connector housing 4 is applied to the flexible flat cable 2 as shown in FIG. 4, the holding part 6 constructed of the resin entering the slits 24 plays the role of a stopper with respect to the direction in which the flexible flat cable 2 is pulled out of the connector housing 4.

In the recess-shaped or U-shaped slits 24 with which both ends in the width direction of the flexible flat cable 2 are provided in the insulating film 22 of the flexible flat cable 2 thus, a coated resin which enters the slits 24 and forms the holding part 6 when a molten resin for forming the holding part 6 enters the slits 24 and the external force of the pull-out direction is applied to the flexible flat cable 2 in the case of coating the insulating film 22 with the resin for forming the holding part 6 plays the role of an engaging protrusion.

That is, the slits 24 are means in which by the resin entering the slits 24, the flexible flat cable 2 is prevented from being detached from the holding part 6 by the external force and the flexible flat cable 2 can surely be held by the holding part 6.

Thus, the flexible flat cable 2 is constructed so that the flexible flat cable 2 can be held more tightly by the holding part 6 in cooperation with the holes 23 and the slits 24.

Example 2

Figure 7A:
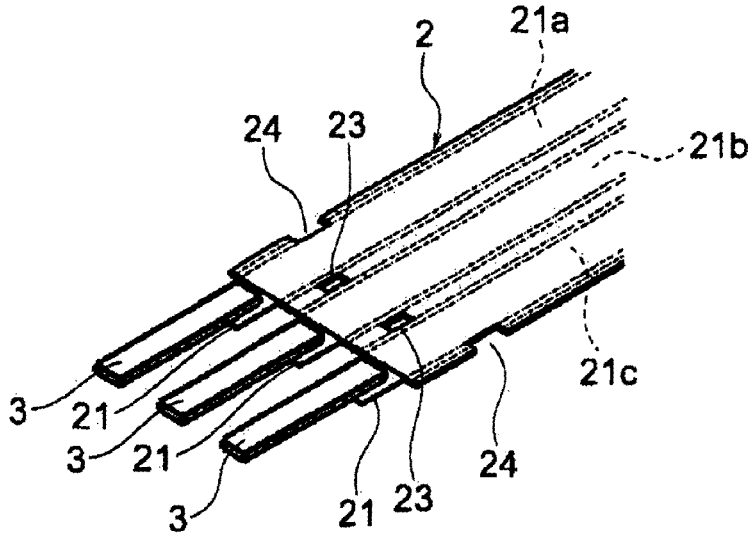
Figure 7B:
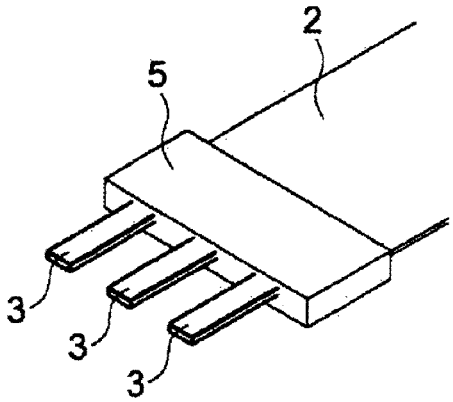
Figure 7B:
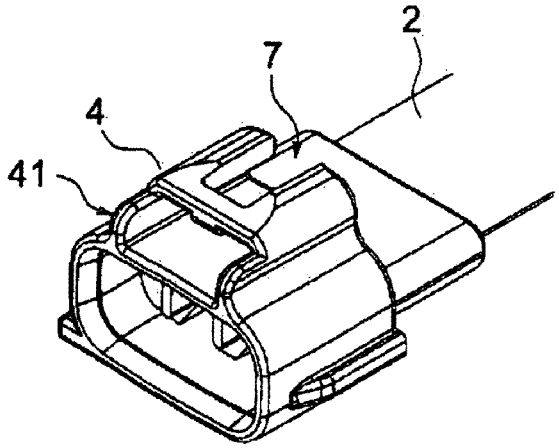
Figure 8:
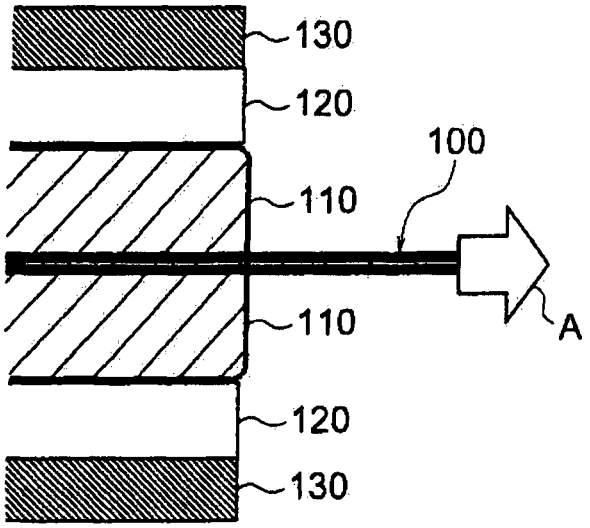
FIG. 8 is a view describing a conventional art.

FIGS. 7A to 7C show an example of a manufacturing method of a flat cable waterproof connector structure according to the embodiment of the invention.

FIGS. 7A to 7C are views showing the manufacturing method of the flat cable waterproof connector structure 1 shown in FIG. 1.

In FIGS. 7A to 7C, the flat cable waterproof connector structure according to the embodiment of the invention has the same configuration as that of the flat cable waterproof connector structure 1 shown in FIGS. 1 to 6.

First, the insulating film 22 of the flexible flat cable 2 at the ends of the sides of connection to the terminals 3 is removed, and each of the conductors 21 (21*a*, 21*b*, 21*c*) is exposed. Then, each of the exposed conductors 21 is contacted to each of the terminals 3 by methods of ultrasonic welding, crimping, etc. (see FIG. 7A).

Next, the sealing part 5 is integrally molded of a thermoplastic elastomer or a resin with high close contact properties so as to cover each of the conductors 21 (21*a*, 21*b*, 21*c*) and the joint part 31 of each of the terminals 3 (see FIG. 7B).

Then, even when the external force A by which the flexible flat cable 2 is pulled out of the connector housing 4 is applied to the flexible flat cable 2, high close contact properties are given to the close contact part 51 and the close contact part 52 and thereby, the close contact properties are not decreased by the external force A and the sufficient close contact properties can be maintained.

Consequently, the terminal 3 with a predetermined distance toward the side of the fitting part 41 of the connector housing 4 from the joint part 31 and the conductor 21 with a predetermined distance toward a longitudinal direction of the flexible flat cable 2 from the joint part 31 are coated so as to include the joint part 31 in which the terminal 3 is contacted to the conductor 21 of the flexible flat cable 2.

Subsequently, the sealing part 5 is coated with the holding part 6 by integral molding so as to cover the sealing part 5, the holes 23 of the flexible flat cable 2, and the slits 24 (see FIG. 7C).

Consequently, a coated resin which enters the holes 23 and forms the holding part 6 when the resin for forming the holding part 6 enters the holes 23 and the slits 24 and the external force A of the pull-out direction is applied to the flexible flat cable 2 plays the role of a stopper and also, the coated resin which enters the slits 24 and forms the holding part 6 plays the role of an engaging protrusion, and a holding force is improved.

Thus, in the invention, a resin with high close contact properties is used in primary molding for forming the sealing part 5 for the purpose of improving sealability in the cable holding part 7 molded integrally to the end of the flexible flat cable 2, and a high rigidity resin is secondarily molded in the holding part 6 for the purpose of improving a holding force and thereby, a structure of ensuring the sealability and the holding force can be obtained.

That is, in the invention, primary molding is performed using the resin with high close contact properties in the sealing part 5 constructing the cable holding part 7 molded integrally to the end of the flexible flat cable 2, and close contact properties of the close contact part 51 in which the terminal 3 makes contact with the sealing part 5 in the sealing part 5 and the close contact part 52 in which the conductor 21 makes contact with the sealing part 5 are improved, and secondary molding is performed using the high rigidity resin in the holding part 6 constructing the cable holding part 7 and thereby, even when the external force A by which the flexible flat cable 2 is pulled out of the connector housing 4 is applied to the flexible flat cable 2, a holding force by which the flexible flat cable 2 is prevented from being pulled out of the connector housing 4 is improved.

In addition, in the flat cable waterproof connector structure 1 of the embodiment of the invention, the case where the terminal 3 is the male terminal is illustrated, but the terminal 3 is not limited to this male terminal, and may be a female terminal.

Also, the flat cable waterproof connector structure 1 of the embodiment of the invention illustrates the case where the connector housing 4 is configured to have the tubular fitting part 41 whose cross section has an oval external shape and the other connector (not shown) is fitted into the inside, but is not limited to this case. That is, other shapes may be used as long as the shape is a shape fitted into the other connector.

The invention implemented by the present inventor has concretely been described above based on the embodiment of the invention described above, but the invention is not limited to the embodiment of the invention described above, and various changes can be made without departing from the gist of the invention.

The present application is based on Japanese Patent Application No. 2011-208478 filed on Sep. 26, 2011, the contents of which are incorporated herein by reference.

INDUSTRIAL APPLICABILITY

A waterproof connector with a flat cable capable of ensuring sealability and a holding force of a flexible flat cable and an integrally molded part even when a pull force (external force) is applied to the flexible flat cable, can be obtained.

REFERENCE SIGNS LIST

1 FLAT CABLE WATERPROOF CONNECTOR STRUCTURE
2 FLEXIBLE FLAT CABLE
3 TERMINAL
4 CONNECTOR HOUSING
5 SEALING PART
6 HOLDING PART
7 CABLE HOLDING PART
21 CONDUCTOR
22 INSULATING FILM
23 HOLE
24 SLIT
31 JOINT PART
41 FITTING PART
51 CLOSE CONTACT PART
52 CLOSE CONTACT PART
A EXTERNAL FORCE

The invention claimed is:

1. A waterproof connector comprising:

a flexible flat cable formed in a flat plate shape and having a plurality of conductors which are arranged in parallel with interval and an insulating film covering the plurality of the conductors;

terminals joined to the conductors of the flexible flat cable respectively at joint parts;

a cable holding part integrally formed to the flexible flat cable so as to hold the cable and at least the joint parts at which the conductors and the terminals are joined; and a connector housing having one end including the cable holding part and the other end at which the mating connector is fitted, wherein a hole is formed between the conductors of the flexible flat cable, and a slit is formed in an end portion of the flexible flat cable in a width direction thereof; and wherein the cable holding part comprises:

a sealing part integrally formed of a thermoplastic elastomer or a resin with high close contact properties to the conductors and the terminals so as to cover and hold the joint parts between the conductors and the terminals; and a holding part integrally formed of a high rigidity resin to the flexible flat cable and covering the sealing part, wherein the holding part of the cable holding part is integrally formed with and continuous from the housing.

2. The waterproof connector according to claim 1, wherein the holding part includes:

a protrusion portion which is entered into the hole of the flexible flat cable; and a retaining part which retains to a part of the slit.

3. A manufacturing method of a waterproof connector, comprising:

providing a flexible flat cable formed in a flat plate shape and having a plurality of conductors which are arranged in parallel with interval and an insulating film covering the plurality of the conductors;

providing terminals joined to the conductors of the flexible flat cable respectively at joint parts;

providing a cable holding part integrally formed to the flexible flat cable so as to hold the cable and at least the joint parts at which the conductors and the terminals are joined;

providing a connector housing;

forming a hole in the insulating film between the conductors of the flexible flat cable;

forming a slit in an end portion of the insulating film of the flexible flat cable in a width direction;

contacting the terminals to the conductors of the flexible flat cable;

forming a sealing part of a thermoplastic elastomer or a resin with high close contact properties integrally to the conductors and the terminals so as to cover and hold the joint parts between the conductors and the terminals;

forming a holding part of a high rigidity resin integrally to the flexible flat cable so as to cover the sealing part;

wherein:

the cable holding part comprises the sealing part and the holding part; and the holding part of the cable holding part is integrally formed with and continuous from the housing.

4. The manufacturing method of the waterproof connector according to claim 3, wherein in the process of forming the sealing part, a high rigidity resin enters into the hole of the flexible flat cable, and a part of the slit is covered with the high rigidity resin.

* * * * *